US010967413B2

(12) United States Patent
Saika et al.

(10) Patent No.: US 10,967,413 B2
(45) Date of Patent: Apr. 6, 2021

(54) FORMING DEVICE

(71) Applicant: SUMITOMO HEAVY INDUSTRIES, LTD., Tokyo (JP)

(72) Inventors: Masayuki Saika, Ehime (JP); Masayuki Ishizuka, Ehime (JP); Norieda Ueno, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 262 days.

(21) Appl. No.: 15/717,692

(22) Filed: Sep. 27, 2017

(65) Prior Publication Data

US 2018/0015519 A1 Jan. 18, 2018

Related U.S. Application Data

(63) Continuation of application No. PCT/JP2016/059683, filed on Mar. 25, 2016.

(30) Foreign Application Priority Data

Mar. 31, 2015 (JP) ..... JP2015-070845

(51) Int. Cl.
*B21D 26/047* (2011.01)
*B21D 37/16* (2006.01)
*B21D 26/033* (2011.01)

(52) U.S. Cl.
CPC ..... *B21D 26/047* (2013.01); *B21D 26/033* (2013.01); *B21D 37/16* (2013.01)

(58) Field of Classification Search
CPC .. B21D 26/033; B21D 26/039; B21D 26/041; B21D 26/043; B21D 26/047
USPC ..... 72/57, 61
See application file for complete search history.

(56) References Cited

U.S. PATENT DOCUMENTS

2007/0101786 A1* 5/2007 Yang ..... B21D 26/033 72/61
2010/0166903 A1* 7/2010 Krajewski ..... B21D 24/16 425/144
2013/0001222 A1* 1/2013 Kaltenboeck ..... C22C 1/002 219/773

FOREIGN PATENT DOCUMENTS

EP 1598129 A1 * 11/2005 ..... B21J 9/08
JP 2012-000654 A 1/2012
JP 2012000654 A * 1/2012 ..... B21D 26/035
WO WO-2014/061473 A1 4/2014
WO WO-2014061473 A1 * 4/2014

OTHER PUBLICATIONS

International Search report issued in Application No. PCT/JP2016/059683, dated Jun. 28, 2016.

* cited by examiner

*Primary Examiner* — Teresa M Ekiert
*Assistant Examiner* — Jared O Brown
(74) *Attorney, Agent, or Firm* — Michael Best & Friedrich LLP

(57) ABSTRACT

A forming device that forms a metal pipe by heating and expanding a metal pipe material includes: a pair of an upper die and a lower die between which the metal pipe material is heated and expanded; upper electrodes and lower electrodes that sandwich both end parts of the metal pipe material therebetween from upper and lower sides to heat the metal pipe material; and a busbar that is connected only to either the upper electrodes or the lower electrodes to supply electric power from a power supply.

18 Claims, 6 Drawing Sheets

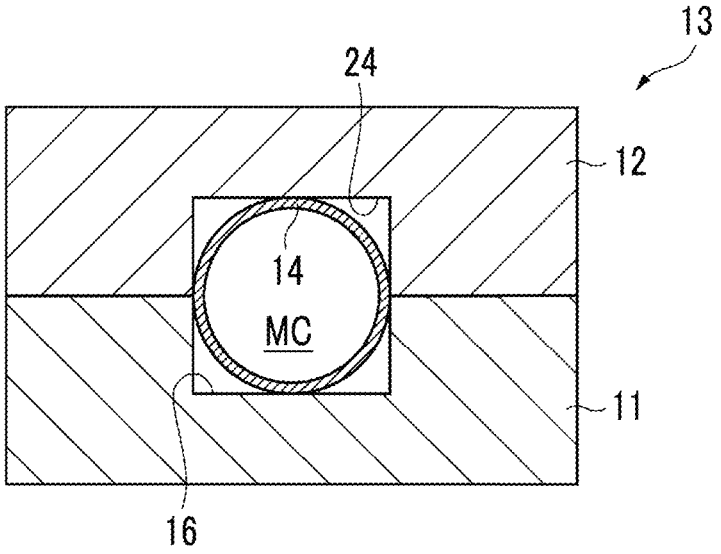
FIG. 6B
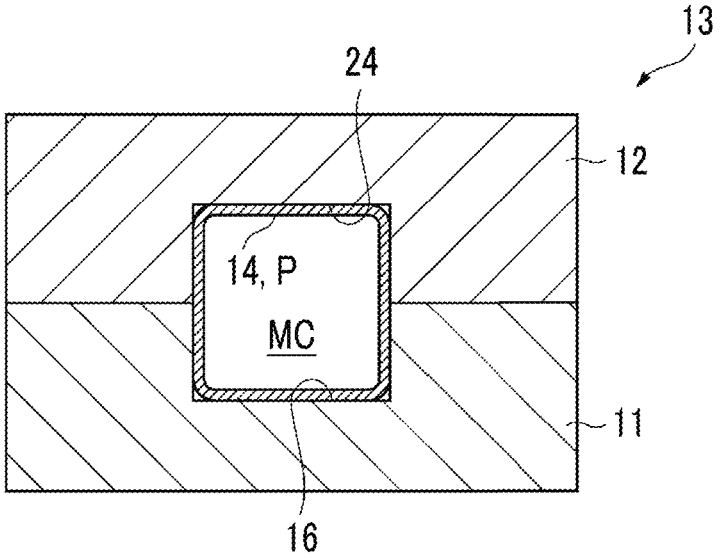

FORMING DEVICE

RELATED APPLICATIONS

Priority is claimed to Japanese Patent Application No. 2015-070845, filed Mar. 31, 2015, and International Patent Application No. PCT/JP2016/059683, the entire content of each of which is incorporated herein by reference.

BACKGROUND

Technical Field

Certain embodiments of the present invention relate to a forming device.

Description of Related Art

For example, a forming device shown in the related art has been known as a forming device that forms a metal pipe having a pipe part and a flange part. The forming device in the related art includes: a first cavity part (main cavity) that is provided with a pair of upper and lower dies and a gas supply part that supplies a gas into a metal pipe material held and heated between the upper die and the lower die, and forms a pipe part by combining the upper die and the lower die together; and a second cavity part (sub-cavity) that communicates with the first cavity part and forms a flange part. In this forming device, the pipe part and the flange part can be simultaneously formed by closing the dies and expanding the metal pipe material with the supply of a gas into the metal pipe material.

SUMMARY

According to an aspect of the invention, there is provided a forming device that forms a metal pipe by heating and expanding a metal pipe material, the device including: a pair of an upper die and a lower die between which the metal pipe material is heated and expanded; upper electrodes and lower electrodes that sandwich both end parts of the metal pipe material therebetween from upper and lower sides to heat the metal pipe material; and a busbar that is connected only to either the upper electrodes or the lower electrodes to supply electric power from a power supply.

BRIEF DESCRIPTION OF THE DRAWINGS

FIG. 2A is a view showing a state in which a metal pipe material is held by the electrodes. FIG. 2B is a view showing a state in which a sealing member is brought into contact with the electrodes. FIG. 2C is a front view of the electrodes.

FIG. 4A is a diagram showing a state in which a metal pipe material is set in a die. FIG. 4B is a diagram showing a state in which the metal pipe material is held by the electrodes.

FIGS. 6A and 6B are cross-sectional views showing a state in which a blow forming die is closed, taken along the line VI-VI shown in FIG. 1. FIG. 6A is a view before the supply of a gas. FIG. 6B is a view when a gas is supplied.

DETAILED DESCRIPTION

Figure 1:
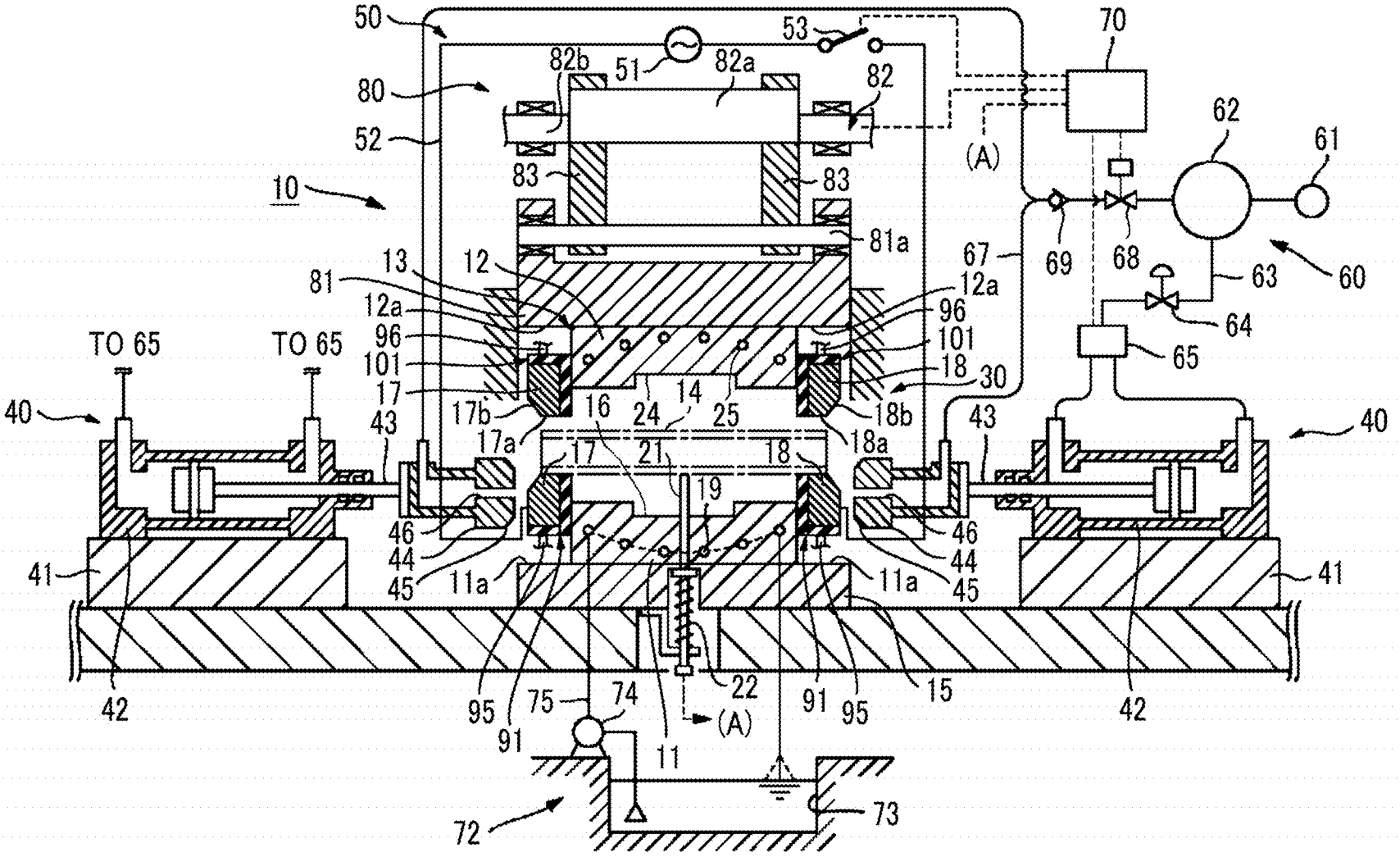
FIG. 1 is a schematic diagram of a configuration of a forming device.

In the forming device, the metal pipe material is energized and heated by electrodes holding both end parts of the metal pipe material in a vertical direction. The electrodes are respectively disposed so as to be drivable in the vertical direction at the sides of end parts of the upper die and end parts of the lower die. Upper and lower electrodes on one side are connected to a positive electrode of a power supply, and upper and lower electrodes on the other side are connected to a negative electrode of the power supply. In this case, a busbar connecting the electrode and the power supply follows the up-and-down movement of the die and the electrode associated with the forming of the metal pipe material. Therefore, in the forming device, it is required to secure a region where each busbar is movable, and there is a tendency for the forming device to be increased in size.

It is desirable to provide a forming device that can be reduced in size.

According to the forming device, the busbar is connected only to either the upper electrodes or the lower electrodes. Accordingly, since the need for a busbar to be connected to the other is eliminated and the entire busbar region is reduced, the forming device can be reduced in size.

Here, the forming device may further include: a driving mechanism configured to move at least one of the upper die and the lower die in a direction in which the dies are combined together, the electrodes on the side of a die to be moved may be moved with the movement of the die, and the busbar may be connected only to the electrodes on the side of one of the upper die and the lower die, having a smaller amount of movement by the driving mechanism than the other. In a case where the busbar is connected only to the electrodes on the side of a die having a smaller amount of movement (including a case where the amount of movement is zero), the region where the busbar is moved is reduced, and thus the forming device can be further reduced in size.

The busbar may be connected only to the lower electrodes. In this case, the connection position of the busbar is lower than in a case where the busbar is connected to the upper electrodes, and thus the dedicated region of the busbar can be reduced. In addition, since most part of the busbar can be arranged on the floor, a short circuit is suppressed in the forming device and safety is thus improved.

The busbar may be laid on the rear surface side of the forming device. In this case, the busbar does not become an obstacle during operations such as the insertion of the metal pipe material into the forming device and the recovery of the formed metal pipe from the forming device. In addition, the chance of contact between the busbar and another object can be extremely reduced.

Lower surfaces of the upper electrodes and upper surfaces of the lower electrodes may be brought into contact with each other in a case where the upper electrodes and the lower electrodes sandwich both end parts of the metal pipe material therebetween from the upper and lower sides. In this case, the electric power supplied from the busbar is directly supplied from one of the lower electrodes and the upper electrodes to the other in a case where both end parts of the metal pipe material are sandwiched from the upper and lower sides. Accordingly, the metal pipe material can be evenly heated without uneven heating.

Hereinafter, preferable embodiments of a forming device according to an aspect of the invention will be described with reference to the drawings. In the drawings, the same or similar parts will be denoted by the same reference signs, and overlapping description will be omitted.

Configuration of Forming Device

FIG. 1 is a schematic diagram of a configuration of a forming device. As shown in FIG. 1, a forming device 10 that forms a metal pipe P (see FIG. 6B) is provided with a blow forming die 13 composed of an upper die 12 and a lower die 11, a driving mechanism 80 that moves at least one of the upper die 12 and the lower die 11, a pipe holding mechanism 30 that holds a metal pipe material 14 between the upper die 12 and the lower die 11, a heating mechanism 50 that energizes the metal pipe material 14 held by the pipe holding mechanism 30 to heat the metal pipe material, a gas supply part 60 for supplying a high-pressure gas (gas) into the metal pipe material 14 held and heated between the upper die 12 and the lower die 11, a pair of gas supply mechanisms 40 for supplying a gas into the metal pipe material 14 held by the pipe holding mechanism 30 from the gas supply part 60, and a water circulation mechanism 72 that forcibly cools the blow forming die 13 with water. In addition, the forming device 10 is provided with a controller 70 that controls driving of the driving mechanism 80, driving of the pipe holding mechanism 30, driving of the heating mechanism 50, and gas supply of the gas supply part 60.

The lower die 11 that is one part of the blow forming die 13 is fixed to a base 15. The lower die 11 is composed of a large steel block and is provided with a rectangular cavity (recessed part) 16 in an upper surface thereof. The lower die 11 has a cooling water passage 19 formed therein and is provided with a thermocouple 21 inserted from the bottom at a substantially center thereof. The thermocouple 21 is supported movably up and down by a spring 22. A space 11*a* is provided near each of right and left ends (right and left ends in FIG. 1) of the lower die 11. In the spaces 11*a*, electrodes 17 and 18 (lower electrodes) to be described later that correspond to a moving part of the pipe holding mechanism 30 are disposed to advance or retreat in a vertical direction. Insulating materials 91 for preventing energization are respectively provided between the lower die 11 and the lower electrode 17 and on the lower side of the lower electrode 17, and between the lower die 11 and the lower electrode 18 and on the lower side of the lower electrode 18. Each insulating material 91 is fixed to an advancing/retreating rod 95 that corresponds to a moving part of an actuator for moving the lower electrodes 17 and 18 constituting the pipe holding mechanism 30 up and down. The fixing part of the actuator having the advancing/retreating rod 95 is held in the base 15 together with the lower die 11.

The upper die 12 that is the other part of the blow forming die 13 is fixed to a slide 81 to be described later that constitutes the driving mechanism 80. The upper die 12 is composed of a large steel block and has a cooling water passage 25 formed therein. The upper die is also provided with a rectangular cavity (recessed part) 24 in a lower surface thereof. The cavity 24 is positioned to be opposed to the cavity 16 of the lower die 11. Similarly to the lower die 11, a space 12*a* is provided near each of right and left ends (right and left ends in FIG. 1) of the upper die 12. In the spaces 12*a*, electrodes 17 and 18 (upper electrodes) to be described later that correspond to a moving part of the pipe holding mechanism 30 are disposed to advance or retreat in the vertical direction. Insulating materials 101 for preventing energization are respectively provided between the upper die 12 and the upper electrode 17 and on the upper side of the lower electrode 17, and between the upper die 12 and the upper electrode 18 and on the upper side of the upper electrode 18. Each insulating material 101 is fixed to an advancing/retreating rod 96 that corresponds to a moving part of an actuator for moving the upper electrodes 17 and 18 constituting the pipe holding mechanism 30 up and down. The fixing part of the actuator having the advancing/retreating rod 96 is held in the slide 81 of the driving mechanism 80 together with the upper die 12.

In a right part of the pipe holding mechanism 30, a semi-arc-shaped recessed groove 18*a* corresponding to an outer peripheral surface of the metal pipe material 14 is formed in each of surfaces in which the electrodes 18 are opposed to each other (see FIG. 2C) such that the metal pipe material 14 can be placed to be well fitted in the recessed groove 18*a*. In the right part of the pipe holding mechanism 30, similarly to the recessed groove 18*a*, a semi-arc-shaped recessed groove (not shown) corresponding to an outer peripheral surface of the metal pipe material 14 is formed in an exposed surface in which the insulating materials 91 and 101 are opposed to each other. In addition, in a front surface of the electrode 18 (a surface of the die in an outward direction), a tapered recessed surface 18*b* is formed such that the vicinity thereof is recessed at an angle into a tapered shape toward the recessed groove 18*a*. Accordingly, in a case where the metal pipe material 14 is sandwiched in the vertical direction in the right part of the pipe holding mechanism 30, the metal pipe material 14 can be surrounded such that the outer periphery of a right end part thereof firmly adheres well over the whole periphery.

In a left part of the pipe holding mechanism 30, a semi-arc-shaped recessed groove 17*a* corresponding to an outer peripheral surface of the metal pipe material 14 is formed in each of surfaces in which the electrodes 17 are opposed to each other (see FIG. 2C) such that the metal pipe material 14 can be placed to be well fitted in the recessed groove 17*a*. In the left part of the pipe holding mechanism 30, similarly to the recessed groove 17*a*, a semi-arc-shaped recessed groove (not shown) corresponding to an outer peripheral surface of the metal pipe material 14 is formed in an exposed surface in which the insulating materials 91 and 101 are opposed to each other. In addition, in a front surface of the electrode 17 (a surface of the die in an outward direction), a tapered recessed surface 17*b* is formed such that the vicinity thereof is recessed at an angle into a tapered shape toward the recessed groove 17*a*. Accordingly, in a case where the metal pipe material 14 is sandwiched in the vertical direction in the left part of the pipe holding mechanism 30, the metal pipe material 14 can be surrounded such that the outer periphery of a left end part thereof firmly adheres well over the whole periphery.

As shown in FIG. 1, the driving mechanism 80 is provided with a slide 81 that moves the upper die 12 so as to combine the upper die 12 and the lower die 11 together, a shaft 82 that generates a driving force for moving the slide 81, and connecting rods 83 for transmitting the driving force generated by the shaft 82. The shaft 82 extends in a horizontal direction above the slide 81, is supported rotatably, and has an eccentric crank 82*a* that is provided with an eccentric shaft 82*b* extending to protrude from right and left ends at positions separated from a center thereof. The eccentric crank 82*a* and a rotation shaft 81*a* provided above the slide 81 and extending in the horizontal direction are connected by the connecting rod 83. In the driving mechanism 80, the controller 70 controls the rotation of the shaft 82 about the eccentric shaft 82*b* to change a height of the eccentric crank 82*a* in the vertical direction and transmit the positional change of the eccentric crank 82*a* to the slide 81 via the connecting rod 83, and thus the up-and-down movement of the slide 81 can be controlled. Here, the oscillation (rotational movement) of the connecting rod 83 that is generated during the transmission of the positional change of the eccentric crank 82*a* to the slide 81 is absorbed by the rotation shaft 81*a*. The shaft 82 is rotated or stopped in accordance with the driving of a motor that is controlled by the controller 70.

As shown in FIG. 1, the heating mechanism 50 has a power supply 51, busbars 52 that respectively extend from the power supply 51, and a switch 53 that is provided in the busbar 52. The busbar 52 is a conductor that is connected only to the respective lower electrodes 17 and 18 and supplies electric power from the power supply 51 to the connected electrodes 17 and 18. The controller 70 controls the heating mechanism 50, and thus the metal pipe material 14 can be heated to a quenching temperature (equal to or higher than an AC3 transformation temperature).

Figure 2A:
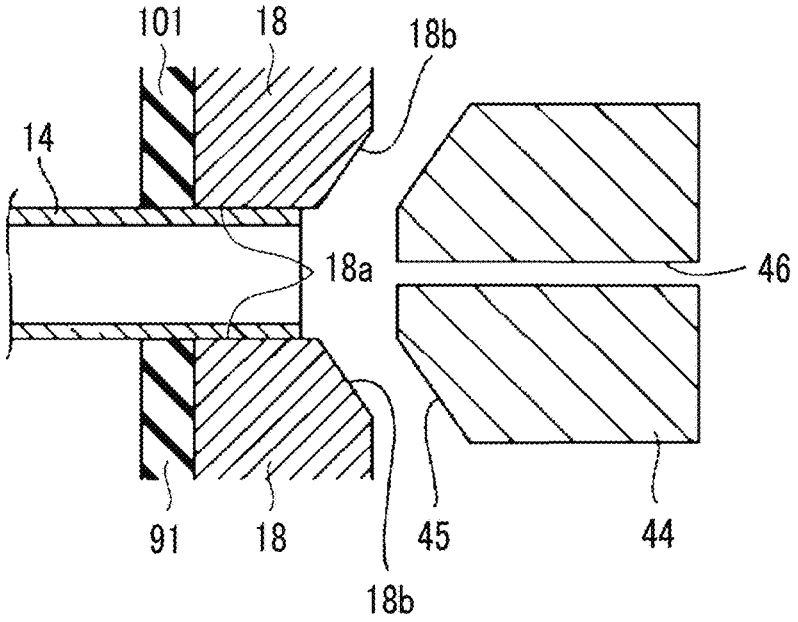
FIGS. 2A to 2C are enlarged views of the vicinity of electrodes.
Figure 2B:
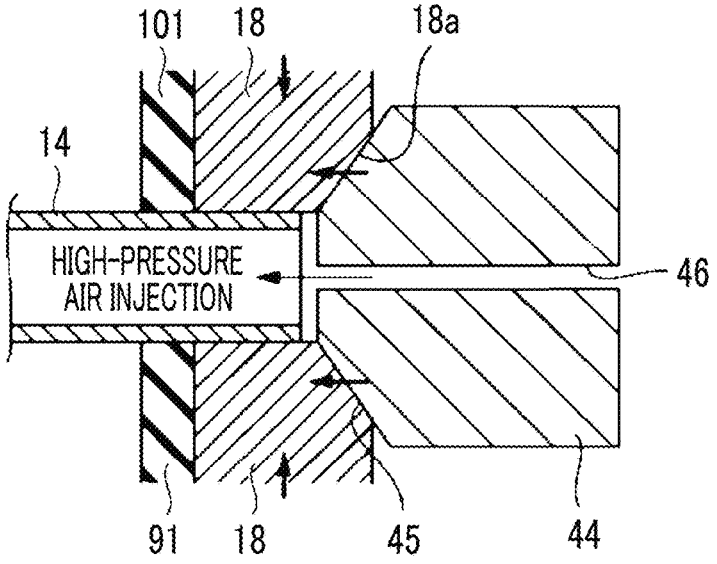

Each of the pair of gas supply mechanisms 40 has a cylinder unit 42, a cylinder rod 43 that advances or retreats in accordance with the operation of the cylinder unit 42, and a sealing member 44 that is connected to a tip end of the cylinder rod 43 on the side of the pipe holding mechanism 30. The cylinder unit 42 is placed and fixed on a block 41. A tapered surface 45 is formed at a tip end of each sealing member 44 so as to be tapered. One tapered surface 45 is formed into such a shape as to be well fitted in and brought into contact with the tapered recessed surface 17*b* of the electrode 17, and the other tapered surface 45 is formed into such a shape as to be well fitted in and brought into contact with the tapered recessed surface 18*b* of the electrode 18 (see FIG. 2). The sealing member 44 is provided with a gas passage 46 that extends from the cylinder unit 42 toward the tip end, specifically, through which a high-pressure gas supplied from the gas supply part 60 flows as shown in FIGS. 2A and 2B.

The gas supply part 60 includes a gas supply 61, an accumulator 62 that stores a gas supplied by the gas supply 61, a first tube 63 that extends from the accumulator 62 to the cylinder unit 42 of the gas supply mechanism 40, a pressure control valve 64 and a switching valve 65 that are provided in the first tube 63, a second tube 67 that extends from the accumulator 62 to the gas passage 46 formed in the sealing member 44, and a pressure control valve 68 and a check valve 69 that are provided in the second tube 67. The pressure control valve 64 functions to supply, to the cylinder unit 42, a gas having an operation pressure adapted for the pressing force of the sealing member 44 with respect to the metal pipe material 14. The check valve 69 functions to prevent the high-pressure gas from flowing backward in the second tube 67.

The pressure control valve 68 provided in the second tube 67 functions to supply a gas having an operation pressure for expanding the metal pipe material 14 to the gas passage 46 of the sealing member 44 by the control of the controller 70.

The controller 70 controls the pressure control valve 68 of the gas supply part 60, and thus a gas having a desired operation pressure can be supplied into the metal pipe material 14. In addition, the controller 70 acquires temperature information from the thermocouple 21 by the transmission of the information from (A) shown in FIG. 1, and controls the driving mechanism 80 and the switch 53.

The water circulation mechanism 72 includes a water tank 73 that stores water, a water pump 74 that draws up and pressurizes the water stored in the water tank 73 to send the water to the cooling water passage 19 of the lower die 11 and the cooling water passage 25 of the upper die 12, and a pipe 75. Although omitted, a cooling tower that lowers the water temperature or a filter that purifies the water may be provided in the pipe 75.

Figure 3:
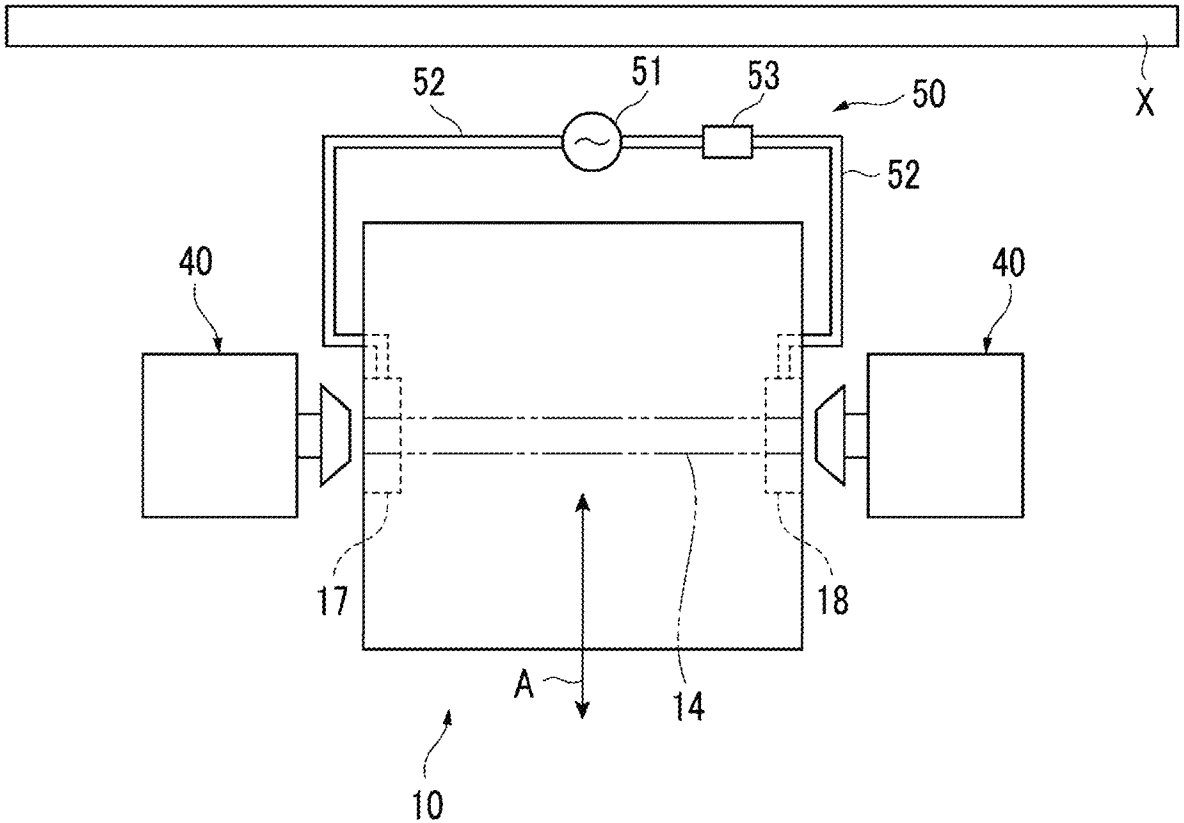
FIG. 3 is a schematic plan view showing the placement of a heating mechanism of the forming device.

Next, the placement of the above-described heating mechanism 50 will be described. As shown in FIG. 3, the metal pipe material 14 is moved in a direction A representing a direction perpendicular to an axial direction thereof in plan view and is thus inserted in the forming device 10. Thereafter, the metal pipe material is placed on the lower electrodes 17 and 18 and the insulating materials 91 (see FIG. 4A) to be sandwiched by the sealing members 44 of the pair of gas supply mechanisms 40 in the axial direction (see FIG. 5). A metal pipe P (see FIG. 6B) formed from the metal pipe material 14 in the forming device 10 is moved in the direction A to be discharged from the forming device 10 (the details will be described later).

The busbar 52 of the heating mechanism 50 is laid on the rear surface side of the forming device 10 (in a depth direction in FIG. 1, in a leftward direction in FIG. 3) and connected to the lower electrodes 17 and 18 so as not to prevent the driving of the pair of gas supply mechanisms 40, the insertion of the metal pipe material 14 into the forming device 10, and the recovery of the metal pipe material P from the forming device 10.

A wall X that functions as a protective wall against some hindrance in the forming device 10 is disposed closer to the rear surface side of the forming device 10 than the busbar 52 of the heating mechanism 50. The wall X is, for example, a concrete wall.

Method of Forming Metal Pipe Using Forming Device

Figure 4A:
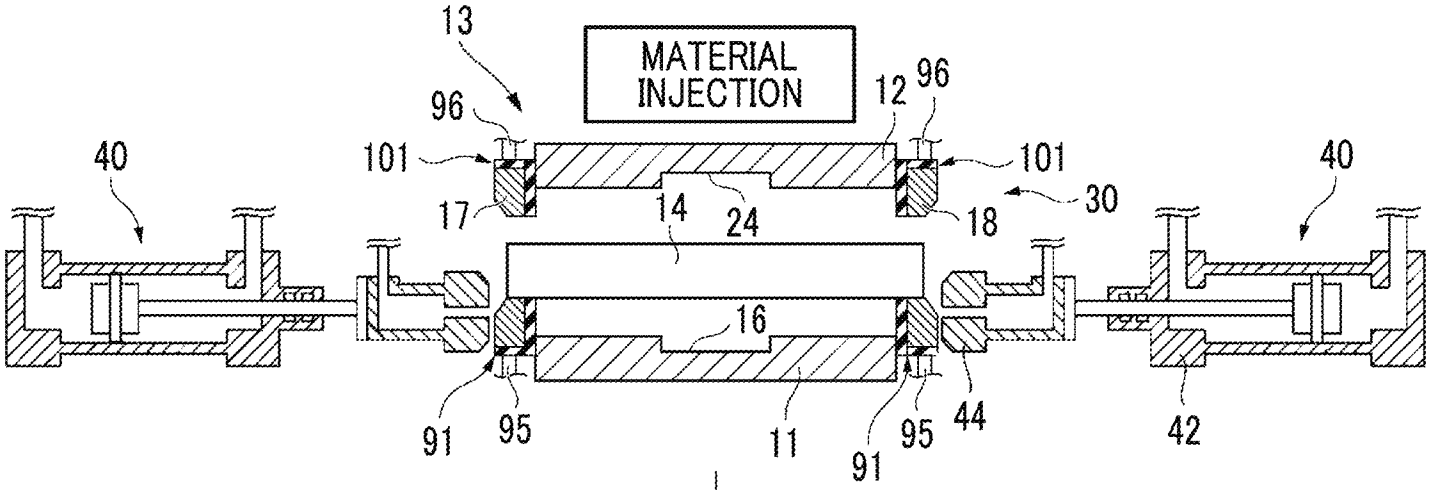
FIGS. 4A and 4B are diagrams showing a manufacturing step using the forming device.
Figure 4B:
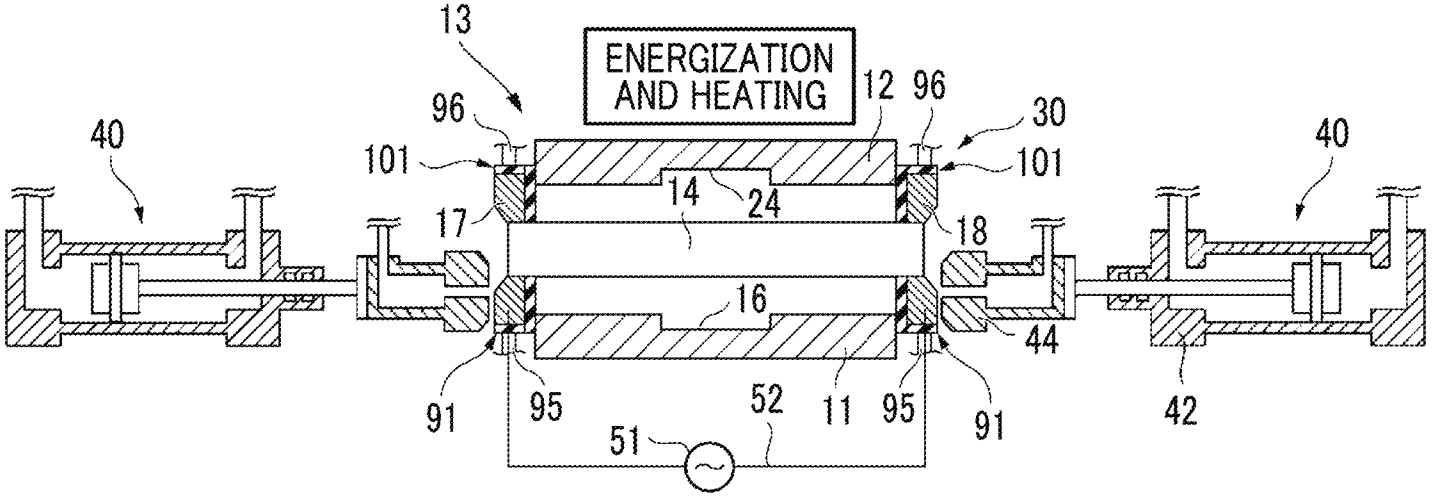

Next, a method of forming a metal pipe using the forming device 10 will be described. FIGS. 4A and 4B show steps from a pipe injection step for injecting the metal pipe material 14 as a material to an energization and heating step for heating the metal pipe material 14 by energization. First, a metal pipe material 14 that is a quenchable steel type is prepared. As shown in FIG. 4A, the metal pipe material 14 is placed (injected) on the first and second electrodes 17 and 18 provided in the lower die 11 using, for example, a robot arm or the like. Since the first and second electrodes 17 and 18 have the recessed grooves 17*a* and 18*a*, respectively, the metal pipe material 14 is positioned by the recessed grooves 17*a* and 18*a*.

Next, the controller 70 (see FIG. 1) controls the driving mechanism 80 (see FIG. 1) and the pipe holding mechanism 30 to hold the metal pipe material 14 by the pipe holding mechanism 30. Specifically, with the driving of the driving mechanism 80 shown in FIG. 1, the upper die 12 held in the slide 81 and the upper electrodes 17 and 18 are moved to the lower die 11, and an actuator (not shown) that allows the upper electrodes 17 and 18 and the lower electrodes 17 and 18 included in the pipe holding mechanism 30 to advance or retreat is operated. Accordingly, as shown in FIG. 4B, both end parts of the metal pipe material 14 are sandwiched from the upper and lower sides by the pipe holding mechanism 30. The sandwiching has an aspect in which the metal pipe material 14 firmly adheres over the whole peripheries of both end parts thereof due to the presence of the recessed grooves 17*a* and 18*a* respectively formed in the electrodes 17 and 18 and the recessed grooves respectively formed in the insulating materials 91 and 101. In this case, the lower surfaces of the upper electrodes 17 and 18 and the upper surfaces of the lower electrodes 17 and 18 are brought into contact with each other. However, the invention is not limited to the configuration in which the metal pipe material 14 firmly adheres over the whole peripheries of both end parts thereof, and may have a configuration in which the electrodes 17 and 18 are brought into contact with a part of the metal pipe material 14 in a peripheral direction.

Next, the controller 70 controls the heating mechanism 50 to heat the metal pipe material 14. Specifically, the controller 70 turns on the switch 53 of the heating mechanism 50. In that case, the electric power that is transmitted from the power supply 51 to the lower electrodes 17 and 18 via the busbar 52 is supplied to the upper electrodes 17 and 18 sandwiching the metal pipe material 14 therebetween and the metal pipe material 14, and the metal pipe material 14 itself produces heat (Joule heat) due to the resistance present in the metal pipe material 14. In this case, the measurement value of the thermocouple 21 is monitored always, and based on the results thereof, the energization is controlled.

Figure 5:
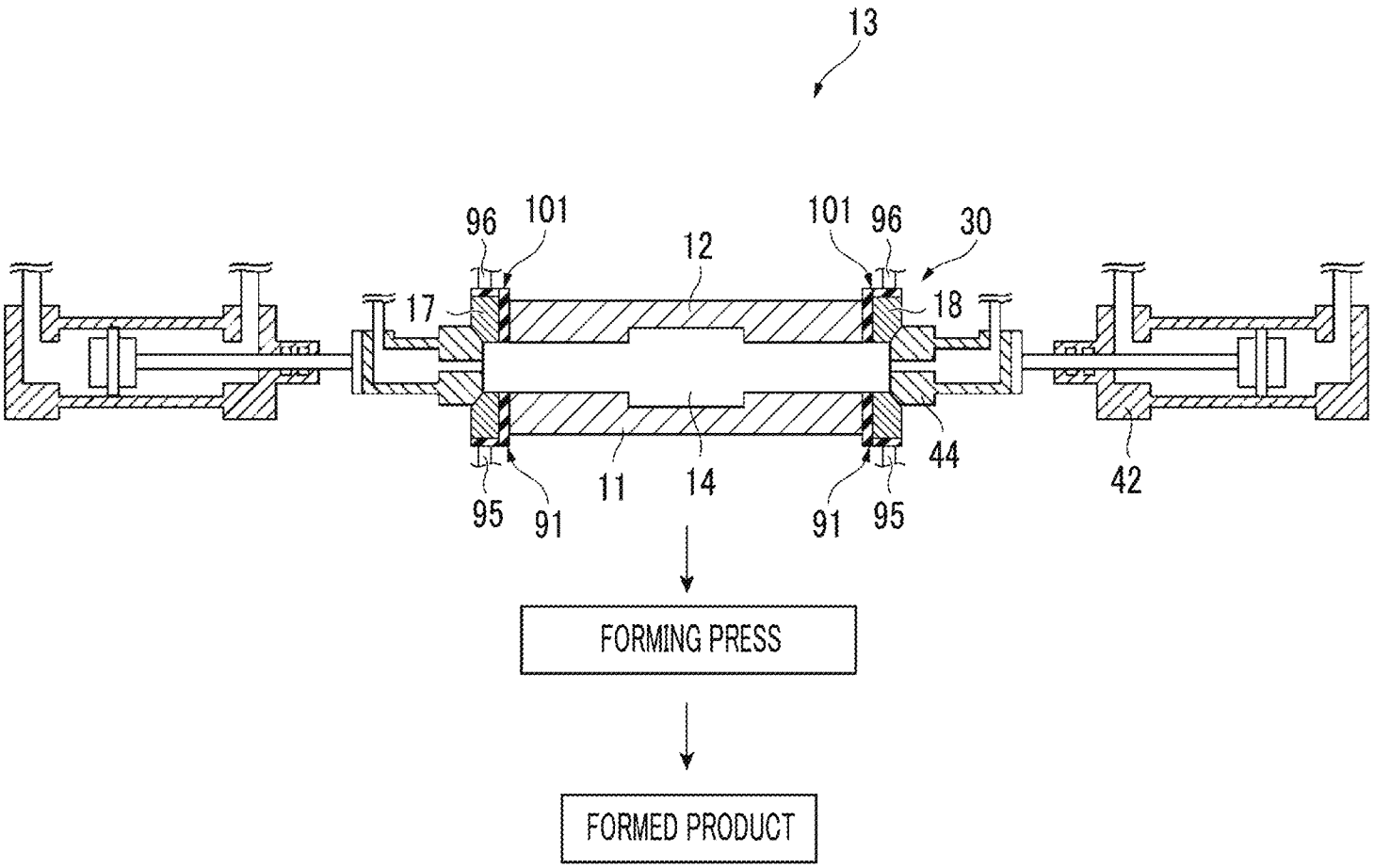
FIG. 5 is a diagram showing an outline of a blow forming step using the forming device and a flow thereafter.

FIG. 5 shows an outline of a blow forming step using the forming device and a flow thereafter. FIGS. 6A and 6B are cross-sectional views showing a state in which the blow forming die is closed, taken along the line VI-VI shown in FIG. 1. FIG. 6A is a view before the supply of a gas and FIG. 6B is a view when a gas is supplied. As shown in FIG. 5, the controller 70 (see FIG. 1) controls the driving mechanism 80 (see FIG. 1) to close the blow forming die 13 with respect to the metal pipe material 14 after heating. Therefore, as shown in FIG. 6A, the metal pipe material 14 is disposed and sealed in a cavity part MC that is a rectangular space formed by combining the cavity 16 of the lower die 11 and the cavity 24 of the upper die 12 together.

Figure 2C:
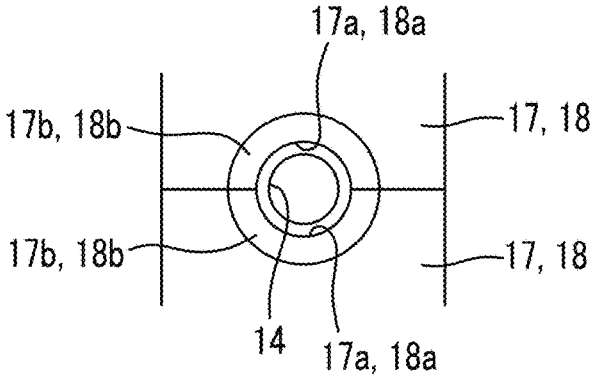

Then, the cylinder unit 42 of the gas supply mechanism 40 is operated to seal both ends of the metal pipe material 14 by the sealing member 44 (see FIGS. 2A to 2C as well). After completion of the sealing, the blow forming die 13 is closed and a high-pressure gas is allowed to flow into the metal pipe material 14 to form the metal pipe material 14 softened by heating along the shape of the cavity part MC (see FIG. 6B).

Since the metal pipe material 14 is softened by being heated at a high temperature (about 950° C.), the gas supplied into the metal pipe material 14 is thermally expanded. Therefore, for example, with the use of compressed air as a gas to be supplied, the metal pipe material 14 at 950° C. can be easily expanded by thermally expanded compressed air.

Quenching is performed in such a way that the outer peripheral surface of the metal pipe material 14 expanded by being subjected to the blow forming is brought into contact with the cavity 16 of the lower die 11 so as to be rapidly cooled, and simultaneously, brought into contact with the cavity 24 of the upper die 12 so as to be rapidly cooled (since the upper die 12 and the lower die 11 have a large heat capacity and are managed at a low temperature, the heat of the pipe surface is taken to the dies at once in a case where the metal pipe material 14 are brought into contact with the dies). Such a cooling method is referred to as die contact cooling or die cooling. Immediately after the rapid cooling, the austenite is transformed to martensite (hereinafter, transformation of austenite to martensite will be referred to as martensite transformation). Since the cooling rate is low in the second half of the cooling, the martensite is transformed to another structure (troostite, sorbate, or the like) owing to recuperation. Therefore, there is no need to perform a separate tempering treatment. In this embodiment, in place of or in addition to the die cooling, a cooling medium may be supplied into the cavity 24 to perform cooling. For example, the metal pipe material 14 may be brought into contact with the die (upper die 12 and lower die 11) to be cooled until the temperature is lowered to a temperature at which the martensite transformation starts, and then, the die may be opened and a cooling medium (gas for cooling) may be allowed to flow to the metal pipe material 14 to cause the martensite transformation.

The metal pipe material 14 is subjected to the blow forming, and then cooled as described above, and the die is opened to obtain a metal pipe P having a main body part with a substantially rectangular tube shape (see FIG. 6B).

According to the above-described forming device 10 of this embodiment, the busbar 52 is connected only to the lower electrodes 17 and 18. Accordingly, a busbar 52 to be connected to the upper electrodes 17 and 18 is not required, and thus the entire busbar region is reduced and the forming device 10 can be reduced in size.

In addition, the busbar 52 is connected only to the lower electrodes 17 and 18. Accordingly, the connection position of the busbar 52 is lower than in a case where the busbar is connected to the upper electrodes 17 and 18, and thus the dedicated region of the busbar 52 can be reduced. In addition, since most part of the busbar 52 can be arranged on the floor, a short circuit is suppressed in the forming device 10 and safety is thus improved.

In addition, since the busbar 52 is laid on the rear surface side of the forming device 10, the busbar 52 does not become an obstacle during operations such as the insertion of the metal pipe material 14 into the forming device 10 and the recovery of the formed metal pipe P from the forming device 10. In addition, the chance of contact between the busbar 52 and another object can be extremely reduced.

In a case where the upper electrodes 17 and 18 and the lower electrodes 17 and 18 sandwich both end parts of the metal pipe material 14 therebetween from the upper and lower sides, the lower surfaces of the upper electrodes 17 and 18 and the upper surfaces of the lower electrodes 17 and 18 may be brought into contact with each other. In this case, the electric power supplied from the busbar 52 is directly supplied from the lower electrodes 17 and 18 to the upper electrodes 17 and 18 in a case where both end parts of the metal pipe material 14 are sandwiched from the upper and lower sides. Accordingly, the metal pipe material 14 can be evenly heated without uneven heating.

Although preferable embodiments of the invention have been described, the invention is not limited to the above-described embodiments. For example, the driving mechanism 80 according to the above-described embodiment moves the upper die 12 only. However, the driving mechanism may move the lower die 11 in addition to or in place of the upper die 12. In these cases, the busbar 52 is connected only to the electrodes 17 and 18 on the side of one of the lower die 11 and the upper die 12, having a smaller amount of movement by the driving mechanism 80 than the other (including a case where the amount of movement is zero). In a case where the busbar 52 is connected only to the electrodes 17 and 18 on the side of a die having a smaller amount of movement as described above, the region where the busbar 52 is moved is reduced, and thus the same effects are obtained as in the above-described embodiments.

In addition, a metal pipe P according to the above-described embodiment may have one or more flange parts. In this case, one or more sub-cavity parts communicating the cavity part MC in a case where the upper die 12 and the lower die 11 are fitted together are formed in the blow forming die 13.

In addition, the driving mechanism 80 according to the above-described embodiment may use, for example, a pressing cylinder, a guide cylinder, and a servo motor in place of the shaft 82. In this case, the slide 81 is suspended by the pressing cylinder, and is guided by the guide cylinder so as not to laterally vibrate. The servo motor functions as a fluid supply part that supplies a fluid (an operating oil in a case where a hydraulic cylinder is employed as the pressing cylinder) for driving the pressing cylinder to the pressing cylinder.

It should be understood that the invention is not limited to the above-described embodiment, but may be modified into various forms on the basis of the spirit of the invention. Additionally, the modifications are included in the scope of the invention.

What is claimed is:

1. A forming device comprising:

a first electrode that, when a metal pipe material is inserted between the first electrode and a second electrode, is movable toward the second electrode in a manner that causes the metal pipe material to come into contact with the first electrode and the second electrode;

a conductor configured to electrically connect the second electrode with a power supply in a manner that, when the metal pipe material comes into the contact with the first electrode and the second electrode, permits the first electrode to receive electric power from the power supply via the second electrode and the metal pipe material; and a first die that, when the metal pipe material is inserted between the first die and a second die, is movable toward the second die in a manner that causes the metal pipe material to come into contact with the first electrode and the second electrode, wherein the second die is moveable by an amount that is smaller than an amount that the first die is moveable.

2. The forming device according to claim 1, wherein the metal pipe material is between the first electrode and the second electrode when the metal pipe material is between the first die and the second die.

3. The forming device according to claim 1, further comprising:

a driving mechanism configured to move the first die toward the second die when the metal pipe material is inserted between the first die and a second die.

4. The forming device according to claim 1, further comprising:

insulating material disposed between the first electrode and the first die so as to electrically insulate the first die from the first electrode.

5. The forming device according to claim 1, further comprising:

insulating material disposed between the second electrode and the second die so as to electrically insulate the second die from the second electrode.

6. A forming device that forms a metal pipe by heating and expanding a metal pipe material, the device comprising:

a first die and a second die between which the metal pipe material is configured to be heated and expanded;

a first electrode and a second electrode that oppose each other and configured to sandwich both end parts of the metal pipe material; and a conductor, wherein:

the first electrode is configured to be movable toward the second electrode in a manner that causes the metal pipe material to come into contact with the first electrode and the second electrode in a state where the metal pipe material is inserted between the first electrode and the second electrode, the first die is configured to be movable toward the second die in a manner that causes the metal pipe material to come into contact with the first electrode and the second electrode in a state where the metal pipe material is inserted between the first die and the second die, the conductor is configured to electrically connect the second electrode to a power supply in a manner that permits the first electrode to receive electric power from the power supply via the second electrode and the metal pipe material when the metal pipe material comes into contact with the first electrode and the second electrode, and an amount of movement of the second die is smaller than an amount of movement of the first die.

7. The forming device according to claim 6, further comprising:

a sealing member that, when the metal pipe material comes into contact with the first electrode and the second electrode, comes into contact with the first electrode and the second electrode in a manner that permits supply of a gas into the metal pipe material.

8. The forming device according to claim 6, wherein the second die is moveable toward the first die.

9. The forming device according to claim 6, further comprising:

a first advancing/retreating rod configured to move the second electrode toward the first electrode.

10. The forming device according to claim 9, wherein the first advancing/retreating rod is configured to retract the second electrode away from the first electrode.

11. The forming device according to claim 6, wherein the first die is configured to be movable toward the second die in a manner that causes the metal pipe material to come into contact with the first electrode and the second electrode when the metal pipe material is inserted between the first die and the second die.

12. The forming device according to claim 11, wherein the metal pipe material is between the first electrode and the second electrode when the metal pipe material is between the first die and the second die.

13. The forming device according to claim 11, further comprising:

a driver configured to move the first die toward the second die when the metal pipe material is inserted between the first die and the second die.

14. The forming device according to claim 11, further comprising:

insulating material disposed between the first electrode and the first die so as to electrically insulate the first die from the first electrode.

15. The forming device according to claim 11, further comprising:

insulating material disposed between the second electrode and the second die so as to electrically insulate the second die from the second electrode.

16. The forming device according to claim 11, further comprising:

a second advancing/retreating rod configured to move the first electrode toward the second electrode.

17. The forming device according to claim 16, wherein the second advancing/retreating rod is configured to move the first electrode independently of the first die.

18. The forming device according to claim 16, wherein the second advancing/retreating rod is configured to retract the first electrode away from the second electrode.

* * * * *